US008939004B2

(12) United States Patent
Yamane et al.

(10) Patent No.: US 8,939,004 B2
(45) Date of Patent: Jan. 27, 2015

(54) METHOD FOR ADJUSTING ROLLING POSITIONS OF ROLLING ROLLS CONSTITUTING THREE-ROLL MANDREL MILL AND METHOD FOR MANUFACTURING SEAMLESS PIPES OR TUBES

(71) Applicants: Akihito Yamane, Tokyo (JP); Shigeru Kidani, Tokyo (JP)

(72) Inventors: Akihito Yamane, Tokyo (JP); Shigeru Kidani, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/728,071

(22) Filed: Dec. 27, 2012

(65) Prior Publication Data

US 2013/0180300 A1 Jul. 18, 2013

Related U.S. Application Data

(63) Continuation of application No. 13/343,319, filed on Jan. 4, 2012, now abandoned, which is a continuation of application No. PCT/JP2010/063060, filed on Aug. 3, 2010.

(30) Foreign Application Priority Data

Aug. 11, 2009 (JP) ..... 2009-186374

(51) Int. Cl.

| | |
|---|---|
| ***B21B 37/72*** | (2006.01) |
| ***B21B 17/02*** | (2006.01) |
| ***B21B 37/78*** | (2006.01) |

(Continued)

(52) U.S. Cl.

CPC ..... *B21B 37/78* (2013.01); *B21B 17/04* (2013.01); *B21B 37/58* (2013.01); *B21B 37/62* (2013.01);

(Continued)

(58) Field of Classification Search

USPC ..... 72/6.2, 7.5, 8.8, 12.5, 96, 97, 208, 209, 72/214, 224, 226, 234, 235, 365.2, 367.1, 72/368, 370.01, 370.14, 370.23–370.25, 72/441–443

See application file for complete search history.

(56) References Cited

U.S. PATENT DOCUMENTS

| | | | | |
|---|---|---|---|---|
| 5,642,638 | A * | 7/1997 | Pietsch et al. | 72/96 |
| 7,707,865 | B2 * | 5/2010 | Sasaki | 72/9.2 |

(Continued)

FOREIGN PATENT DOCUMENTS

| | | |
|---|---|---|
| JP | 63-238906 | 10/1988 |
| JP | 08-019805 | 1/1996 |

(Continued)

*Primary Examiner* — Shelley Self
*Assistant Examiner* — Pradeep C Battula
(74) *Attorney, Agent, or Firm* — Clark & Brody

(57) ABSTRACT

[Problem to be Solved]

A device for adjusting the rolling positions of rolling rolls and restraining poor roll-biting of the front edge part of a pipe material rolled by a three-roll mandrel mill includes pressing-down devices 1 (P1 to P6) for moving rolling rolls R1 to R6 in the rolling direction and a control unit 2 for controlling the pressing-down devices 1. Immediately after the front edge part of a pipe material T has begun to be rolled by the rolling rolls disposed on at least one rolling stand of the rolling rolls R1 to R6, the control unit 2 controls the pressing-down device 1 to move the rolling rolls in the closing direction. Preferably, the rolling rolls disposed on at least one rolling stand of the rolling rolls R1 to R6 in the closing direction are moved at a speed of 16 mm/sec or higher using the pressing-down device 1.

4 Claims, 2 Drawing Sheets

(51) Int. Cl.

| | |
|---|---|
| ***B21B 17/04*** | (2006.01) |
| *B21B 37/58* | (2006.01) |
| *B21B 37/62* | (2006.01) |
| *B21B 38/00* | (2006.01) |

(52) U.S. Cl.

CPC ..... *B21B 38/00* (2013.01); *B21B 2261/10* (2013.01); *B21B 2271/02* (2013.01); *B21B 2273/14* (2013.01); *B21B 2273/16* (2013.01); *B21B 2275/06* (2013.01)

USPC ..... 72/370.01; 72/234; 72/208; 72/12.5

(56) References Cited

U.S. PATENT DOCUMENTS

| | | | | |
|---|---|---|---|---|
| 7,937,978 | B2 | 5/2011 | Iwamoto | |
| 2010/0218576 | A1* | 9/2010 | Felkl | 72/6.2 |

FOREIGN PATENT DOCUMENTS

| | | |
|---|---|---|
| JP | 2005-111518 | 4/2005 |
| WO | 2006/0106938 | 10/2006 |

* cited by examiner

METHOD FOR ADJUSTING ROLLING POSITIONS OF ROLLING ROLLS CONSTITUTING THREE-ROLL MANDREL MILL AND METHOD FOR MANUFACTURING SEAMLESS PIPES OR TUBES

This application is a Continuation of U.S. Ser. No. 13/343,319 filed on Jan. 4, 2012, which is a Continuation of PCT/JP2010/063060 filed on Aug. 3, 2010, which is published as WO/2011/018956 on Feb. 17, 2011.

TECHNICAL FIELD

The present invention relates to a device for adjusting the rolling positions of rolling rolls constituting a three-roll mandrel mill used for manufacturing seamless pipes or tubes. More particularly, the present invention relates to a rolling position adjusting device capable of restraining poor roll-biting of the front edge part of a pipe or tube material rolled by a three-roll mandrel mill or capable of restraining a decrease in circumferential length of the rear edge part of the pipe or tube material. Hereinafter, "pipe or tube" is referred to as "pipe" when deemed appropriate.

BACKGROUND ART

As a mandrel mill that is equipment for manufacturing seamless pipes, a two-roll mandrel mill has conventionally been used in which two opposed rolling rolls (grooved rolls) are disposed on respective rolling stands, and are arranged alternately so that the rolling direction of rolling roll of a rolling stand is shifted by 90 degrees from that of an adjacent rolling stand. Also, a three-roll mandrel mill has been used in which three rolling rolls (grooved rolls) are disposed on respective rolling stands so that the angle between the rolling directions is 120 degrees, and are arranged alternately so that the rolling direction of rolling roll of a rolling stand is shifted by 60 degrees from that of an adjacent rolling stand.

It has been known that the three-roll mandrel mill is less liable to a problem of plastic deformation such as poor piercing of pipe material than the two-roll mandrel mill.

Therefore, in the case where the three-roll mandrel mill is used, to decrease the equipment size (reduce the number of rolling stands) or to increase the manufacturing capability, it is thought that the working ratio of pipe material per one rolling stand is increased as compared with the case where the two-roll mandrel mill is used.

However, the increase in the working ratio of pipe material per one rolling stand poses a problem that it is difficult for the front edge part of pipe material to bite stably (to secure the roll-biting property). In particular, in the case where the three-roll mandrel mill is used, the change in roll diameter of rolling roll is smaller (the difference between the roll diameter of a groove bottom part and the roll diameter of a flange part is smaller) than the case where the two-roll mandrel mill is used. Therefore, it is more difficult to secure the roll-biting property of the front edge part of pipe material in the case where the three-roll mandrel mill is used.

Also, it has been found that due to the non-steady phenomenon at the time when the pipe material is rolled, as shown in FIG. 4, the cross sections of the pipe edges (the front pipe edge and the rear pipe edge) have a long circumferential length because of being free ends, but excluding the pipe edges, the circumferential length of the rear edge part is short partially. In particular, in the case where the three-roll mandrel mill is used, it is more difficult to secure the circumferential length than the case where the two-roll mandrel mill is used (for example, refer to JP2005-111518A, paragraph 0004). Therefore, in the case where the three-roll mandrel mill is used, it is necessary to compensate for a non-steady portion (a portion in which the circumferential length is short partially) in the rear edge part.

SUMMARY OF INVENTION

The present invention has been made to solve the above problems of prior art, and accordingly an object thereof is to provide a rolling position adjusting device capable of restraining poor roll-biting of the front edge part of a pipe or tube material rolled by a three-roll mandrel mill or capable of restraining a decrease in circumferential length of the rear edge part of the pipe or tube material.

To solve the above problems, the present inventor conducted studies earnestly, and resultantly found that poor roll-biting of the front edge part of pipe or tube material can be restrained if rolling rolls are put on standby at a position at which they are open more as compared with the rolling time (at a position distant from the center of pipe or tube material) before the front edge part of pipe or tube material begins to be rolled, and the rolling rolls are moved in the closing direction (in the direction of approaching the center of pipe or tube material) immediately after the front edge part of pipe or tube material has begun to be rolled. The present invention was completed based on this new knowledge of the present inventor.

The present invention provides a device for adjusting the rolling positions of rolling rolls disposed on at least one rolling stand constituting a three-roll mandrel mill, the device comprising: a pressing-down device for moving the rolling rolls in the rolling direction; and a control unit for controlling the pressing-down device, wherein immediately after a front edge part of a pipe or tube material has begun to be rolled by the rolling rolls, the control unit controls the pressing-down device to move the rolling rolls in the closing direction.

Preferably, the control unit moves the rolling rolls in the closing direction at a speed of 16 millimeters per second or higher by using the pressing-down device.

According to the above-described preferred configuration, the yield of the front edge part of pipe or tube material can be increased.

The present invention also provides a method for manufacturing seamless pipes or tubes, wherein a three-roll mandrel mill that adopts the device for adjusting the rolling positions of rolling rolls described above is used.

Also, to solve the above problems, the present inventor conducted studies earnestly, and resultantly found that a decrease in circumferential length of the rear edge part of pipe or tube material can be restrained if the rolling rolls are moved in the closing direction (in the direction of approaching the center of pipe or tube material) beyond the rolling position at the time when the central part of pipe or tube material is rolled immediately after the rear edge part of pipe or tube material has begun to be rolled. The present invention was completed based on this new knowledge of the present inventor.

The present invention provides a device for adjusting the rolling positions of rolling rolls disposed on at least one rolling stand constituting a three-roll mandrel mill, the device comprising: a pressing-down device for moving the rolling rolls in the rolling direction; and a control unit for controlling the pressing-down device, wherein immediately after a rear edge part of a pipe or tube material has begun to be rolled by the rolling rolls, the control unit controls the pressing-down device to move the rolling rolls in the closing direction.

Preferably, the control unit moves the rolling rolls in the closing direction at a speed of 16 millimeters per second or higher by using the pressing-down device.

According to the above-described preferred configuration, the yield of the rear edge part of pipe or tube material can be increased while the decrease in circumferential length of the rear edge part is restrained.

The present invention also provides a method for manufacturing seamless pipes or tubes, wherein a three-roll mandrel mill that adopts the device for adjusting the rolling positions of rolling rolls described above is used.

According to the present invention, poor roll-biting of the front edge part of pipe or tube material rolled by the three-roll mandrel mill can be restrained. Also, according to the present invention, the decrease in circumferential length of the rear edge part of pipe or tube material can be restrained.

DESCRIPTION OF EMBODIMENTS

One embodiment of the present invention will now be described with reference to the accompanying drawings as appropriate.

Figure 1:
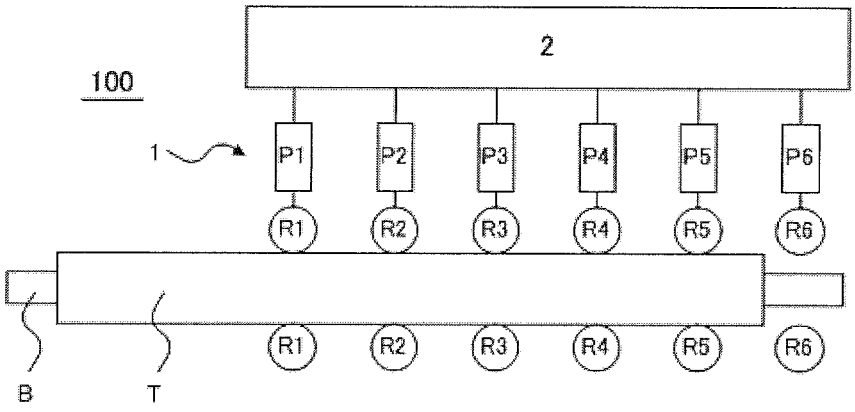
FIG. 1 is a schematic view showing a general configuration of a rolling position adjusting device for rolling rolls constituting a three-roll mandrel mill in accordance with one embodiment of the present invention.

FIG. 1 is a schematic view showing a general configuration of a rolling position adjusting device for rolling rolls constituting a three-roll mandrel mill in accordance with one embodiment of the present invention.

As shown in FIG. 1, a rolling position adjusting device 100 in accordance with this embodiment is used in a three-roll mandrel mill consisting of a total of six rolling stands on each of which three rolling rolls are disposed to elongation-roll the outside surface of a pipe material T in the state in which a mandrel bar B is inserted into the pipe material T in a spit form. Describing more specifically, the rolling position adjusting device 100 in accordance with this embodiment is configured so as to be capable of adjusting the rolling positions of the rolling rolls R1 to R6 disposed on the respective rolling stands of the mandrel mill. For convenience, in FIG. 1, the rolling rolls R1 to R6 are shown so that two rolling rolls are disposed on each of the rolling stands. Actually, however, there are three rolling rolls R1, three rolling rolls R2, and so on up to R6 disposed so that the angle between the rolling directions is 120 degrees.

The rolling position adjusting device 100 has pressing-down devices 1 (P1 to P6) for moving the rolling rolls R1 to R6 in the rolling direction respectively, and a control unit 2 for controlling the pressing-down devices 1.

The pressing-down device 1 is configured by a hydraulic cylinder or the like.

The control unit 2 receives detection signals sent from a detector (not shown), which is provided on the entrance side of mandrel mill to detect the front edge or the rear edge of the pipe material T, and detection signals sent from a sensor (for example, a pulse generator attached to a conveyance roller for the pipe material T) for detecting the conveyance speed of the pipe material T. Based on the received detection signals, the control unit 2 detects the timing of roll-biting of the front edge of the pipe material T with the rolling stand or the timing of withdrawal of the rear edge of the pipe material T from the rolling stand.

Immediately after the front edge part of the pipe material T has begun to be rolled by the rolling rolls disposed on at least one rolling stand of the rolling rolls R1 to R6, the control unit 2 controls the pressing-down device 1 to move the concerned rolling rolls in the closing direction.

Figure 2:
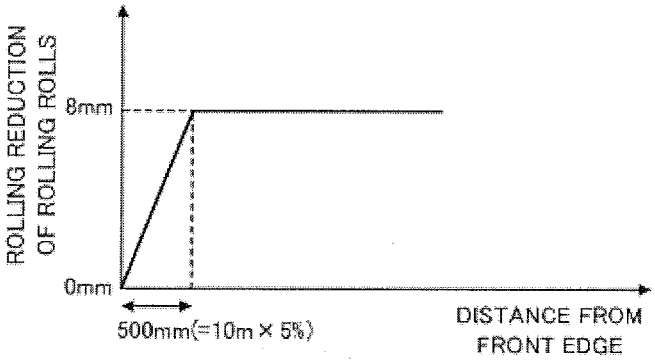
FIG. 2 is a graph schematically showing one example of a change in rolling reduction of rolling rolls R1 at the time when the front edge part of a pipe material T is rolled by a first rolling stand (a rolling stand on which the rolling rolls R1 are disposed) shown in FIG. 1.

FIG. 2 is a graph schematically showing one example of a change in rolling reduction of the rolling rolls R1 at the time when the front edge part of the pipe material T is rolled by a first rolling stand (a rolling stand on which the rolling rolls R1 are disposed). As shown in FIG. 2, for example, in the front edge part of the pipe material T, the rolling rolls R1 are closed so that the rolling reduction changes from 0 mm to 8 mm immediately after the start of rolling. Also, it is assumed that the length of the pipe material T is 10 m, and a length region of 5% from the front edge of the pipe material T (that is, a range of 500 mm from the front edge) may have poor wall thickness. That is, it is assumed that the rolling rolls R1 may be closed so that the rolling reduction is 8 mm in the period from the time when the front edge of the pipe material T bites onto the first rolling stand to the time when it passes through a position of 500 mm. If the conveyance speed of the pipe material T is, for example, 1 m/sec, 0.5 sec elapses in the period from the time when the front edge of the pipe material T bites onto the first rolling stand to the time when it passes through a position of 500 mm. In order to make the rolling reduction 8 mm in the time period of 0.5 sec (that is, to move the rolling rolls R1 through 8 mm in the closing direction), the rolling rolls R1 must be moved in the closing direction at a speed of 16 mm/sec. As in the example shown in FIG. 2, in order to increase the yield of the front edge part of the pipe material T (to reduce the length region having poor wall thickness to 5% or less), it is preferable that the control unit 2 move the rolling rolls R1 in the closing direction at a speed of 16 mm/sec or higher by using the pressing-down device 1. In the case where the length region having poor wall thickness may be longer than 5% from the front edge of the pipe material T, for example, in the case where the length region having poor wall thickness may be 6%, the rolling rolls R1 may be moved in the closing direction at a speed of 13 mm/sec or higher.

Poor roll-biting does not necessarily occur on the first rolling stand only. The movement of the rolling rolls R1 in the closing direction immediately after the start of rolling of the front edge part of the pipe material T on the first rolling stand substantially reduces the rolling reduction of the front edge part on the first rolling stand. If the rolling reduction of the front edge part is decreased as described above on the first rolling stand, the rolling reductions on the second and subsequent rolling stands increase. Therefore, it is desirable to control the pressing-down devices 1 on the second and subsequent rolling stands as necessary as on the above-described first rolling stand. For example, when the front edge part of the pipe material T is rolled on the sixth rolling stand shown in FIG. 1 (the rolling stand on which the rolling rolls R6 are disposed), the rolling reduction of the rolling rolls R6 is changed as described below. For example, in the front edge part of the pipe material T, the rolling rolls R6 are closed so that the rolling reduction changes from 0 mm to 0.8 mm immediately after the start of rolling. Also, it is assumed that the length after rolling of the pipe material T is 15 m, and a length region of 1% from the front edge of the pipe material T (that is, a range of 150 mm from the front edge) may have poor wall thickness. That is, it is assumed that the rolling rolls R6 may be closed so that the rolling reduction becomes 0.8 mm in the period from the time when the front edge of the pipe material T bites onto the sixth rolling stand to the time when it passes through a position of 150 mm. If the conveyance speed after rolling of the pipe material T is, for example, 3 m/sec, 0.05 sec elapses in the period from the time when the front edge of the pipe material T bites onto the sixth rolling stand to the time when it passes through a position of 150 mm. In order to make the rolling reduction 0.8 mm in the time period of 0.05 sec (that is, to move the rolling rolls R6 through 0.8 mm in the closing direction), the rolling rolls R6 must be moved in the closing direction at a speed of 16 mm/sec. In order to increase the yield of the front edge part of the pipe material T so as to reduce the length region having poor wall thickness to 1% or less, it is preferable that the control unit 2 move the rolling rolls R6 in the closing direction at a speed of 16 mm/sec or higher by using the pressing-down device 1.

Immediately after the rear edge part of the pipe material T has begun to be rolled by the rolling rolls disposed on at least one rolling stand of the rolling rolls R1 to R6, the control unit 2 controls the pressing-down device 1 to move the concerned rolling rolls in the closing direction.

Figure 3:
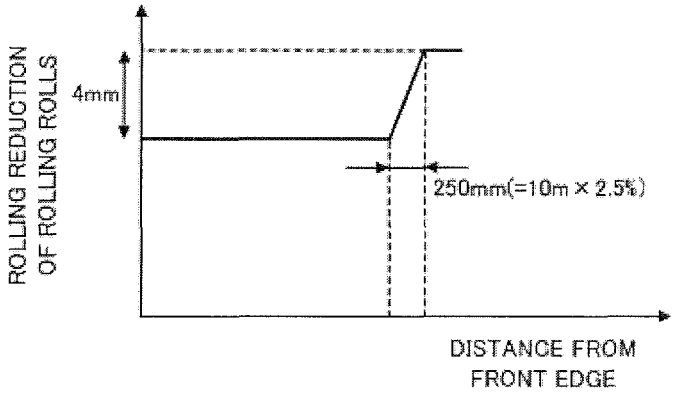
FIG. 3 is a graph schematically showing one example of a change in rolling reduction of rolling rolls R1 at the time when the rear edge part of a pipe material T is rolled by a first rolling stand (a rolling stand on which the rolling rolls R1 are disposed) shown in FIG. 1.
Figure 4:
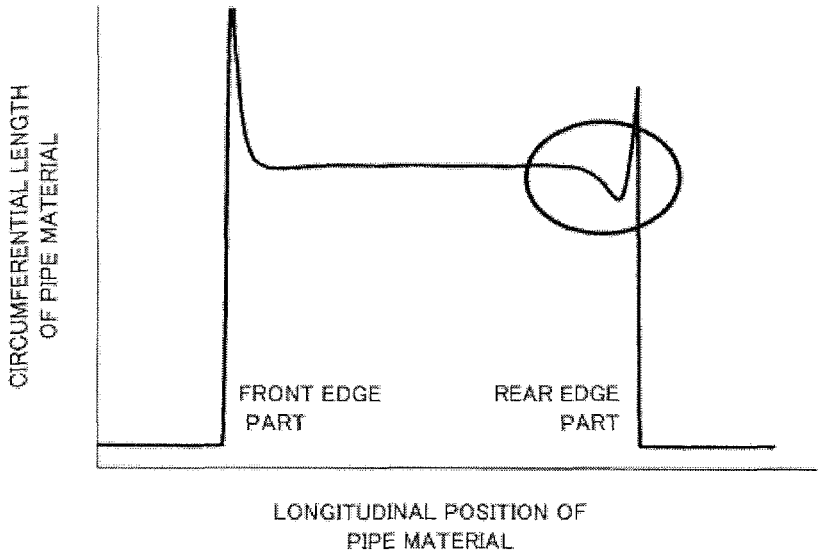
FIG. 4 is a graph showing one example of a change in circumferential length of a pipe material with respect to longitudinal direction of the pipe material, which is caused by a non-steady phenomenon when the pipe material is rolled by a mandrel mill.

FIG. 3 is a graph schematically showing one example of a change in rolling reduction of the rolling rolls R1 at the time when the rear edge part of the pipe material T is rolled by the first rolling stand. As shown in FIG. 3, for example, in the rear edge part of the pipe material T, the rolling rolls R1 are closed so that the rolling reduction increases by 4 mm immediately after the start of rolling. It is assumed that the length of the pipe material T is 10 m, and a length region of 2.5% from the first position of the rear edge part of the pipe material T (that is, a range of 250 mm from the first position of the rear edge part) may have poor wall thickness. That is, it is assumed that the rolling rolls R1 may be closed so that the rolling reduction becomes 4 mm in the period from the time when the first position of the rear edge part of the pipe material T bites onto the first rolling stand to the time when it passes through a position of 250 mm. If the conveyance speed of the pipe material T is, for example, 1 m/sec, 0.25 sec elapses in the period from the time when the first position of the rear edge part of the pipe material T bites onto the first rolling stand to the time when it passes through a position of 250 mm. In order to make the rolling reduction 4 mm in the time period of 0.25 sec (that is, to move the rolling rolls R1 through 4 mm in the closing direction), the rolling rolls R1 must be moved in the closing direction at a speed of 16 mm/sec. As in the example shown in FIG. 2, in order to increase the yield of the rear edge part of the pipe material T (to reduce the length region having poor wall thickness to 2.5% or less), it is preferable that the control unit 2 move the rolling rolls R1 in the closing direction at a speed of 16 mm/sec or higher by using the pressing-down device 1. In the case where the length region having poor wall thickness may be longer than 2.5% from the first position of the rear edge part of the pipe material T, for example, in the case where the length region having poor wall thickness may be 3%, the rolling rolls R1 may be moved in the closing direction at a speed of 13 mm/sec or higher.

Difficulty in securing the circumferential length does not necessarily arise on the first rolling stand only. Rather, in order to draw the mandrel bar B out of the pipe material T once rolling is completed in the mandrel mill, it is important to secure the circumferential length of the pipe material T after rolling on the final rolling stand. Therefore, it is desirable to control the pressing-down devices 1 on the second and subsequent rolling stands, especially on the final rolling stand, as necessary as on the above-described first rolling stand. Considering the equipment investment cost, the pressing-down device 1 may be controlled on the fifth and sixth rolling stands only. For example, when the rear edge part of the pipe material T is rolled on the sixth rolling stand shown in FIG. 1 (the rolling stand on which the rolling rolls R6 are disposed), the rolling reduction of the rolling rolls R6 is changed as described below. For example, in the rear edge part of the pipe material T, the rolling rolls R6 are closed so that the rolling reduction increases by 2 mm immediately after the start of rolling. It is assumed that the length after rolling of the pipe material T is 15 m, and a length region of 2.5% from the first position of the rear edge part of the pipe material T (that is, a range of 375 mm from the first position of the rear edge part) may have poor wall thickness. That is, it is assumed that the rolling rolls R6 may be closed so that the rolling reduction becomes 2 mm in the period from the time when the first position of the rear edge part of the pipe material T bites onto the sixth rolling stand to the time when it passes through a position of 375 mm. If the conveyance speed of the pipe material T is, for example, 3 m/sec, 0.125 sec elapses in the period from the time when the first position of the rear edge part of the pipe material T bites onto the sixth rolling stand to the time when it passes through a position of 375 mm. In order to make the rolling reduction 2 mm in the time period of 0.125 sec (that is, to move the rolling rolls R6 through 2 mm in the closing direction), the rolling rolls R6 must be moved in the closing direction at a speed of 16 mm/sec. In order to increase the yield of the rear edge part of the pipe material T (to reduce the length region having poor wall thickness to 2.5% or less), it is preferable that the control unit 2 move the rolling rolls R6 in the closing direction at a speed of 16 mm/sec or higher by using the pressing-down device 1.

The invention claimed is:

1. A method for adjusting the rolling positions of rolling rolls disposed on at least a first rolling stand and a second rolling stand constituting a three-roll mandrel mill during rolling a pipe or tube material, the method comprising:

using a pressing-down device for moving the rolling rolls in the rolling direction and a control unit for controlling the pressing-down device;

immediately after a front edge part of the pipe or tube material has begun to be rolled by the rolling rolls, making the control unit control the pressing-down device to move the rolling rolls in the rolling direction so as to approach the center of the pipe or tube material at a speed of 16 millimeters per second or higher; and thereafter making the control unit control the pressing-down device to keep the rolling positions of the moved rolling rolls;

wherein the first rolling stand indicates a rolling stand that is situated on the most upstream side in the conveyance direction of the pipe or tube material among rolling stands constituting the three-roll mandrel mill, the second rolling stand indicates a rolling stand that is directly adjacent to the first rolling stand among rolling stands constituting the three-roll mandrel mill, and the front edge part of the pipe or tube material indicates an edge part on the downstream side in the conveyance direction of the pipe or tube material in the three-roll mandrel mill.

2. A method for manufacturing seamless pipes or tubes, wherein a three-roll mandrel mill that adopts the method for adjusting the rolling positions of rolling rolls described in claim 1 is used.

3. A method for adjusting the rolling positions of rolling rolls disposed on at least one rolling stand constituting a three-roll mandrel mill during rolling a pipe or tube material, the method comprising:

using a pressing-down device for moving the rolling rolls in the rolling direction and a control unit for controlling the pressing-down device; and immediately after a rear edge part of the pipe or tube material has begun to be rolled by the rolling rolls, making the control unit control the pressing-down device to move the rolling rolls in the rolling direction so as to approach the center of the pipe or tube material at a speed of 16 millimeters per second or higher, wherein the rear edge part of the pipe or tube material indicates an edge part on the upstream side in the conveyance direction of the pipe or tube material in the three-roll mandrel mill.

4. A method for manufacturing seamless pipes or tubes, wherein a three-roll mandrel mill that adopts the method for adjusting the rolling positions of rolling rolls described in claim 3 is used.

* * * * *